United States Patent [19]

Crews et al.

[11] Patent Number: 4,574,187

[45] Date of Patent: Mar. 4, 1986

[54] SELF REGULATING PTCR HEATER

[75] Inventors: James E. Crews, North Adams; George H. Rodriguez, Williamstown, both of Mass.

[73] Assignee: Sprague Electric Company, North Adams, Mass.

[21] Appl. No.: 182,548

[22] Filed: Aug. 29, 1980

[51] Int. Cl.[4] ..... H05B 3/10

[52] U.S. Cl. ..... 219/541; 219/505; 219/553; 338/22 R

[58] Field of Search ..... 219/210, 345, 504, 505, 219/541, 548, 549, 522, 241, 553; 338/22 R, 22 SD, 23, 24, 25, 27, 28, 323, 324, 332, 316, 372, 266, 313, 327

[56] References Cited

U.S. PATENT DOCUMENTS

| | | | |
|---|---|---|---|
| 2,861,163 | 11/1958 | Asakawa | 219/241 |
| 3,188,594 | 6/1965 | Koller et al. | 338/28 |
| 3,243,753 | 3/1966 | Kohler | 219/241 |
| 3,287,684 | 11/1966 | Armbruster, Jr. | 219/345 |
| 3,748,439 | 7/1973 | Ting et al. | 219/505 |
| 3,885,129 | 5/1975 | Fabricius | 338/22 R |
| 4,037,082 | 7/1977 | Tamada et al. | 219/505 |
| 4,242,567 | 12/1980 | Carter | 219/505 |

FOREIGN PATENT DOCUMENTS

| | | | |
|---|---|---|---|
| 2046935 | 5/1971 | Fed. Rep. of Germany | 219/504 |

*Primary Examiner*—Bernard Roskoski

[57] ABSTRACT

A self regulating ceramic PTCR (positive temperature coefficient of resistance) heater has a pair of spaced interdigitated electrodes on one major surface of a ceramic PTCR plate. A heat transfer means is provided for extracting heat from the opposite major surface of the PTCR plate. Best heating efficiency is obtained when the thickness of the PTCR plate is about the same or is less than the average spacing between the electrodes.

8 Claims, 2 Drawing Figures

SELF REGULATING PTCR HEATER

BACKGROUND OF THE INVENTION

This invention relates to temperature regulating PTCR heaters and more particularly to such a heater wherein the electrodes and means for contacting the electrodes are on one side of a PTCR ceramic plate and an electrically insulative film is bonded directly to the other side of the plate. A ceramic PTCR heater plate having a pair of interdigitated electrodes confined to one major surface of the plate is described in the patent to Fabricius U.S. Pat. No. 3,885,129 issued May 20, 1975 that is assigned to the same assignee as is the present invention. This plate is illustrated in the patent in FIGS. 5 through 9 and shows an object to be heated being spaced from the one electroded surface by an insulative layer. When a source of electrical energy is connected between the two electrodes current flows predominently at that one major surface between the electrodes. Thus the object to be heated is only separated from the central source of heat by the interposed electrically insulative film. Contact pads for the electrodes are thus placed on the opposite major surface of the plate to avoid further separation of the heated object from the heating surface of the PTCR ceramic.

The electrodes are typically formed by screen printing a metal paste on the one major surface of the plate. The termination pads on the opposite surface may likewise be screen printed. Connection between them is made by applying a strip of the metal containing paste to the plate edges. The plate is then heated to cure the electrodes, edge coatings and termination pads.

However, it has been found that the edge coatings constitute a major cause of failure since the edge coatings tend to become very thin at the corners and causes the electrical current density to be excessively high at these edges. Consequently this electrical connection tends to overheat and open the circuit. The problem may be ameliorated by grinding the ceramic plate edges to round them prior to applying the conductive edge coatings, but at additional cost.

It is an object of this invention to provide a PTCR heater requiring no edge connections and with all metallizations confined to one major PTCR plate surface.

It is a further object of this invention to provide a reliable low cost self regulating heater.

SUMMARY OF THE INVENTION

A self regulating PTCR heater includes a ceramic PTCR plate having a pair of interdigitated film electrodes bonded to one major surface thereof. An electrodes termination means is provided at that electroded surface by which an electrical energy source may be electrically connected between the two electrodes. At the opposite major surface of the PTCR plate a heat transfer means is provided to extract heat from that surface of the PTCR plate. For example, an insulative film abutting the aforesaid opposite surface provides electrical insulation and the heat transfer means to an object to be heated. The immediate object to be heated may be a metal heat sink plate that is a part of the heater assembly and upon which a further object, such as a cup of coffee, may be heated. For best efficiency it is preferred that the thickness of the PTCR plate be no greater than the average spacing between the two electrodes. The heating efficiency of this PTCR heater is surprisingly commensurate with those of the prior art wherein the heat transfer means to the object to be heated is at the electroded surface of the PTCR plate, which is the surface at which the generation of heat tends to be the greatest.

DESCRIPTION OF THE PREFERRED EMBODIMENT

Figure 1:
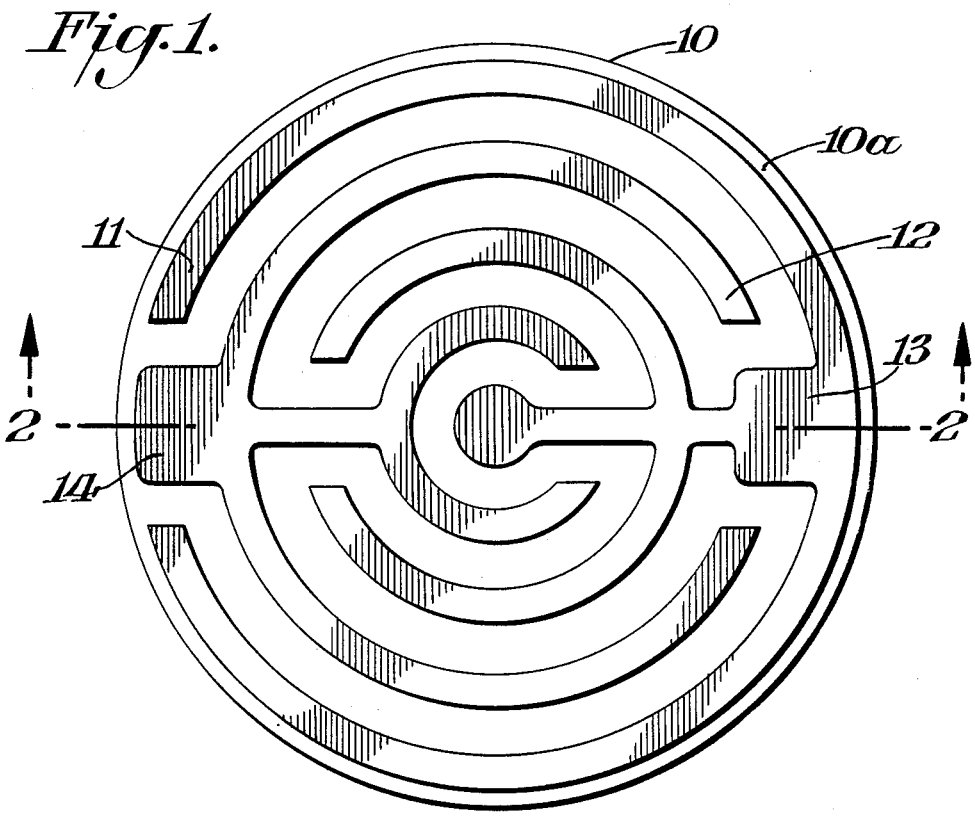
FIG. 1 shows a view of a major surface of a ceramic PTCR plate of this invention having a pair of interdigitated electrodes bonded thereto.

A PTCR ceramic plate 10 in FIG. 1 has two finger-like electrodes 11 and 12 bonded to a major surface 10*a* of the plate 10. The distance between the adjacent electrodes 11 and 12 is approximately constant everywhere toward achieving a constant current density and even heat generation in the intervening surface portions of the plate 10. Each of the electrodes 11 and 12 have contiguous enlarged termination pad portions 13 and 14, respectively, located on the same major surface 10*a*.

Figure 2:
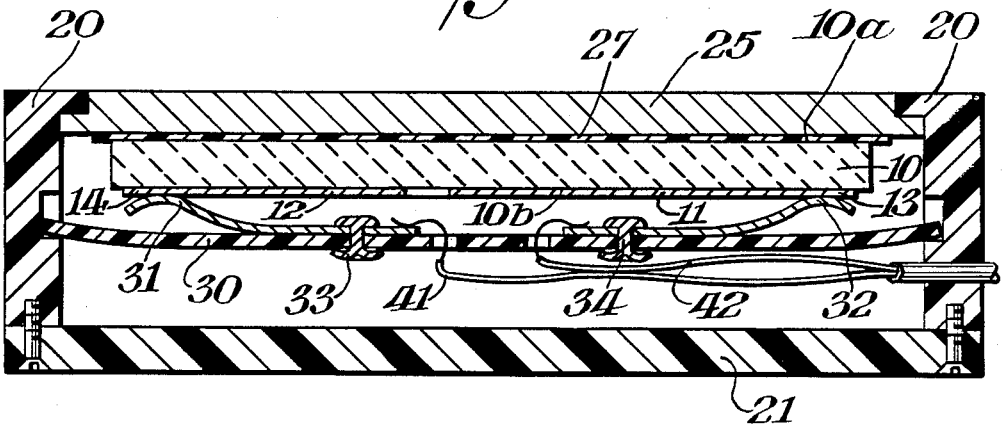
FIG. 2 shows in side sectional view the PTCR plate of FIG. 1 being mounted in a housing.

With reference to FIG. 2, the PTCR plate 10 is mounted in an insulative housing consisting of a cylindrical part 20 and a bottom cover 21. An aluminum plate 25 is fitted into the remaining opening in the housing part 20. The opposite major surface 10*b* of PTCR plate 10 is spaced from the aluminum plate 25 by a 0.005 inch (0.125 mm) thick film of polyimide 27 to provide electrical insulation therebetween.

A flexible glass-epoxy board 30 has two phosphor bronze contact strips 31 and 32 attached by means of rivets 33 and 34, respectively. The board 30 is constrained within housing part 20 to provide pressure contact between each of the strips 31 and 32 and the contact pad portions 14 and 13, respectively of electrodes 12 and 11, respectively. Pressure contact is also effected by this means between the three members, aluminum plate 25, polyimide film 27 and PTCR plate 10.

Insulated lead wires 41 and 42 have their respective ends welded to strips 31 and 32. These wires exit the housing part 20 for connection to an electrical energy source (not shown).

In order to achieve optimum thermal conductivity between the aluminum plate 25 and the PTCR plate surface 10*a* it is preferred to apply a layer of thermally conductive paste (not shown) between the polyimide and each of the plates 25 and 10. Such a paste, designated XTHERM, is supplied by the Transene Company, Inc., Rowley, Mass.

The PTCR plate 10 of this embodiment is of a standard semiconducting barium titanate material having a Curie temperature of about 120° C. Plate 10 has a diameter of 1.25 inch (32 mm) and has a thickness of 0.060 inch (1.5 mm). The plate 10, as originally pressed and fired was 0.120 inch (3.0 mm) thick and was subsequently ground to the thinner dimension before applying the electrodes 11 and 12.

In an experiment, a number of the above described 0.120 inch thick PTCR plates of the same production lot, were divided into two groups. The first group (I) was ground to a thickness of 0.060 inch (1.5 mm) while the second (II) remained at 0.100 inch (2.5 mm). An interdigitated electrode pattern as in FIG. 1, wherein the electrodes 11 and 12 are spaced apart by 0.075 inch (1.9 mm), was screen printed on one major surface of each of the plates in both groups. The first group I was further divided into two subgroups IA and IB. For those of subgroup IA, termination pads were provided on the major surface opposite the electrodes while for those of subgroup IB termination pads were provided on the same side as the electrodes as in FIG. 2. Thus the PTCR plates of group II and subgroup IA had termination pads on the opposite side from the electrodes as in Fabricius while the subgroup IB has terminations on the electroded side according to this invention. A 0.005 inch (0.13 mm) polyimide film was sandwiched between the electrodes of subgroup IB and a 4×4 inches (102×102 mm) aluminum block while a similar insulative film separated the flat metal-free opposite surfaces of plates in group II and subgroup IA from identical 4×4 inches aluminum blocks. In each case, 120 volt AC was applied between the pair of electrodes, 11 and 12. The rate of heat delivery was measured from the assemblies of each group and subgroup. The standard units of group II (Fabricius) delivered 50 watts. Those in group IA delivered only 25 watts. However, those of the invention, namely of subgroup IB, delivered 45 watts.

Had the experimental plates (subgroup IB) been ground only a little thinner there is no doubt that they would perform as well or better than the conventional units (IA and II). In any event, the omission of edge connections in PTCR heaters of this invention eliminates the possibility of failures there and reduces manufacturing costs.

From the experimental data and from theoretical considerations, it is preferred that the thickness of the PTCR plate be no greater than the average spacing between the adjacent of the electrodes in order to provide efficient heating.

It is also preferred to use a low cost glass bonded aluminum material for the electrodes as taught by G. Rodriguez and J. Maher in U.S. Pat. No. 4,053,864 issued Oct. 11, 1977 that is assigned to the same assignee as is the present invention. Such aluminum electrodes are substantially thicker, e.g. greater than 0.001 inch (0.025 mm), than the more conventional silver containing electrode systems. When the thick aluminum electrodes are employed in a conventional heater, an even further spacing between the PTCR heating surface and the object to be heated occurs, while the thick low cost aluminum electrodes used in a heater of the present invention have no such shortcomings.

What is claimed is:

1. A self regulating PTCR heater comprising a ceramic PTCR plate, a pair of interdigitated film electrodes being bonded to one major surface of said plate, and an electrodes terminations means at said one major surface for electrically connecting said electrodes to an electrical energy source, the opposite major surface of said plate being entirely metal free to enable efficient heat transfer therefrom to an abutting object to be heated.

2. The PTCR heater of claim 1 additionally comprising an electrical terminal means for connecting said electrical energy source to said terminations means at said one surface.

3. The PTCR heater of claim 1 additionally comprising a housing having an opening on one face thereof, said PTCR plate being mounted in said housing with said insulated other surface being oreinted toward and registered with said opening so that said housing may be positioned with said opening upward and said object to be heated may rest upon said insulated other surface.

4. The PTCR heater of claim 1 additionally comprising a metal heat sink plate abutting said insulative film.

5. The PTCR heater of claim 1 wherein said electrodes are spaced apart everywhere at a substantially equal distance.

6. The PTCR heater of claim 1 wherein the thickness of said PTCR plate is no greater than the average spacing between said electrodes.

7. The PTCR heater of claim 1 wherein said electrodes are of a glass bonded aluminum material.

8. The PTCR heater of claim 1 additionally comprising an electrically insulating film in direct contact with essentially all of the opposite major surface of said PTCR plate so that with a source of electrical energy connected between said pair of electrodes, an object that is pressed against said insulative film will be heated and maintained at a constant temperature.

* * * * *

UNITED STATES PATENT AND TRADEMARK OFFICE

CERTIFICATE OF CORRECTION

PATENT NO. : 4,574,187

DATED : March 4, 1986

INVENTOR(S) : James E. Crews et al

It is certified that error appears in the above—identified patent and that said Letters Patent is hereby corrected as shown below:

Column 4,

Under the heading "What is claimed is:"

In each of issued claims 2 through 7,

"claim 1" should read -- claim 8 --

Signed and Sealed this

*Third* Day of *June 1986*

[SEAL]

*Attest:*

DONALD J. QUIGG

*Attesting Officer*

*Commissioner of Patents and Trademarks*